252-99 AU 166 EX
3/7/78 OR 4,077,897

United States Patent [19]
Gault

[11] 4,077,897
[45] Mar. 7, 1978

[54] PROCESS FOR PREPARING DETERGENT COMPOSITIONS

[75] Inventor: Terrell Wilson Gault, Cincinnati, Ohio

[73] Assignee: The Procter & Gamble Company, Cincinnati, Ohio

[21] Appl. No.: 657,991

[22] Filed: Feb. 13, 1976

[51] Int. Cl.[2] ..... C11D 7/38
[52] U.S. Cl. ..... 252/99; 252/135; 252/156; 252/174; 23/313 AS; 264/117
[58] Field of Search ..... 252/99, 135, 156, 174; 264/117; 23/313

[56] References Cited

U.S. PATENT DOCUMENTS

| | | | |
|---|---|---|---|
| 3,248,330 | 4/1966 | Feirstein et al. | 252/156 |
| 3,454,499 | 7/1969 | Walker | 252/135 |
| 3,598,743 | 8/1971 | Coates | 252/135 |
| 3,625,902 | 12/1971 | Summer | 252/135 |
| 3,630,928 | 12/1971 | Fuchs | 252/135 |
| 3,682,829 | 8/1972 | Cooper et al. | 252/99 |
| 3,687,640 | 8/1972 | Sams et al. | 252/135 |
| 3,741,904 | 6/1973 | Christensen | 252/99 |
| 3,819,526 | 6/1974 | Pierce | 252/135 |
| 3,888,781 | 6/1975 | Kingry | 252/135 |
| 3,899,436 | 8/1975 | Copeland et al. | 252/135 |

*Primary Examiner*—Mayer Weinblatt
*Attorney, Agent, or Firm*—Steven J. Goldstein; Robert B. Aylor; Richard C. Witte

[57] ABSTRACT

A granular detergent composition for use in automatic dishwashing machines is prepared by forming a dry mix of an alkali metal condensed phosphate and an anhydrous alkali metal silicate of small particle size and agglomerating the dry mix with a silicate solution. Conventional surfactants can be included in the composition. The process is particularly suited to the preparation of automatic dishwashing machine detergents having relatively low levels of phosphate builders.

13 Claims, No Drawings

PROCESS FOR PREPARING DETERGENT COMPOSITIONS

BACKGROUND OF THE INVENTION

This invention relates to a process for preparing detergent compositions, in particular compositions suitable for use in automatic dishwashing machines and having relatively low levels of phosphate builders.

Detergent compositions of the above type are conventionally prepared by an agglomeration process wherein a dry mix of solid, hydratable ingredients is formed and is sprayed or otherwise contacted with water or an aqueous solution of other ingredients to form a granular product. Typical processes of this type are described in U.S. Pat. No. 3,598,743, issued Aug. 10, 1971 to K. Coates, U.S. Pat. No. 3,888,781, issued June 10, 1975 to Kingry and Lahrman, and U.S. Pat. No. 3,625,902, issued Dec. 7, 1971 to Summer.

The above patents refer to the desirability of obtaining a product which is free-flowing and resistant to caking. Traditionally, there have been problems in preparing such agglomerated compositions which were non-caking and which had good carton storage stability. While the processes of the above patents provide a product having acceptable caking properties, these patents are generally concerned with products having high levels of hydratable builder salts, especially sodium tripolyphosphate. In recent years, there has been some concern over environmental problems associated with phosphates in detergents, and it is therefore desirable that phosphate levels in detergents of this type be reduced. Unfortunately, it has been found that reduction of the level of hydratable materials such as sodium tripolyphosphate leads to an increase in the severity of the caking problem with agglomerated detergent compositions.

Accordingly, it is an object of the present invention to provide a process for preparing a free-flowing, non-caking detergent composition. It is a further object of the invention to provide a process for preparing an agglomerated detergent composition having a relatively low level of phosphate builder salts.

Another object of the invention is to produce a non-caking automatic dishwashing detergent composition.

SUMMARY OF THE INVENTION

According to the present invention, there is provided a process for preparing a granular detergent composition comprising the steps of:

(a) forming a particulate mixture comprising from about 5% to about 35% by weight of the composition of a substantially anhydrous alkaline condensed phosphate and from about 3% to about 10% by weight of the composition of anhydrous alkali metal silicate having a particle size in the range from about 125 to about 300 mesh; and (b) with continous mixing, spraying said particulate mixture with from about 10% to about 35% by weight of the composition of an aqueous solution of an alkali metal silicate having an $SiO_2$/alkali metal ratio in the range from about 1.0 to about 3.6 to form agglomerated granules.

Other dry ingredients, for example a bleaching agent such as chlorinated trisodium phosphate, and a filler such as sodium sulfate, can be added to the particulate mixture either before or during the agglomerating step. A surfactant, preferably a nonionic surfactant, is normally included in the composition and is preferably sprayed onto the agglomerated granule concurrently with the spraying on of the aqueous silicate solution.

In the present specification, the term "mesh" refers to a Tyler Standard Mesh. A material having a particle size of, for example, 300 mesh consists of particles substantially all of which pass through a Tyler 300 mesh sieve.

DETAILED DESCRIPTION OF THE INVENTION

The first step in the process of the invention consists of the formation of a particulate mixture of dry ingredients of the composition. This dry mix contains two essential ingredients, an alkaline condensed phosphate and an anhydrous alkali metal silicate.

Wherever it appears herein, the term "alkaline condensed phosphate" is used to designate those polyphosphates of the calcium and magnesium ion sequestering type whose $Na_2O/P_2O_5$ ratios range from 1:1 to 1.67:1. A highly preferred condensed phosphate is sodium tripolyphosphate.

Preferably the anhydrous sodium tripolyphosphate is of the so-called "granular" grade, that is having particle size such that not more than 20% passes a 100 mesh U.S. test sieve. Normally at least 15% of sodium tripolyphosphate by weight of the composition is used. If less is used it becomes increasingly difficult to obtain satisfactory agglomerates through in some cases as little as 5% may give an acceptable product. At the other extreme, about 35%, and preferably 30%, of condensed phosphate is the upper limit contemplated in the present invention. While levels higher than 35% can be used in effective compositions, prior art processes, such as those described in the above-cited art, can usually provide compositions having good caking properties.

The essence of the present invention lies in the inclusion of an anhydrous alkali metal, preferably sodium, silicate in the dry particulate mixture formed in the first step of the process. It will be understood that "dry" ingredients are not necessarily anhydrous. Indeed, conventional "dry" silicate, as used, for example, in U.S. Pat. No. 3,598,743, can contain as much as 18.5% water of hydration.

In the present invention, the use of anhydrous silicate of a particular particle size is essential as the silicate component of the dry mix must necessarily absorb part of the moisture from the aqueous phase which is sprayed onto the particulate mixture.

The particulate mixture formed in the process of the present invention must contain from about 3% to about 10% of anhydrous silicate salt, preferably from 4% to 6%. Additionally, this silicate must have a particle size of between about 125 and about 300 mesh, preferably from 190 to 250 mesh.

It has been found that commercial sodium metasilicate, which has a particle size of between about 20 mesh and about 65 mesh is unsuitable for use in the present invention as the relatively large silicate particles are insufficiently soluble to dissolve completely in use of the composition.

Sodium silicate having a ratio of $SiO_2/Na_2O$ from about 1.0 to about 3.6 can be used in the invention; preferably the $SiO_2/Na_2O$ ratio is about 2.0.

Additional particulate components that can be included with the alkaline builder salts include sodium sulfate, a chlorine-yielding bleach such as chlorinated trisodium phosphate, various known suds suppressors, coloring matter, and dyes.

The term "chlorinated trisodium phosphate" is used to designate a composition consisting of trisodium phosphate and sodium hypochlorite in intimate association in a crystalline form. The chlorinated trisodium phosphate may contain from 1% to 5% available chlorine and may be prepared by the methods of U.S. Letters Patent 1,555,474 or 1,965,304, or modifications thereof. The proportion used in the invention can vary quite widely according to the intended use of the product, for instance from 1% to about 50% by weight, but for most purposes a content of 5% to 35% by weight is preferable.

As the first step of the process of the present invention, the above-described particulate matter is charged to a mixing zone. Any suitable mixing device such as an inclined pan granulator, a rotating drum, or any other vessel with suitable means of agitation may be used. Methods of agitating the particulate components are well-known to those skilled in the art.

The second step in the process of the invention consists of spraying an aqueous solution of alkali metal silicate onto the above-described particulate mixture. In a highly preferred process, the mixture is sprayed with an aqueous solution of sodium silicate having weight ratio of $SiO_2$ to $Na_2O$ of from 1:1 to 3.6:1, preferably about 2:1 to 3.3:1. The optimum amout and concentration of the silicate solution depends on a number of factors such as the actual $SiO_2/Na_2O$ ratio; the nature of the dry mixture, especially its content of sodium tripolyphosphate; the amount of anhydrous silicate, the type of mixing device; and the like. The amount should be such as to cause the particulate mixture to form a bed of agglomerated granules, but not so great that its particulate nature is destroyed. Usually between about 10% and 35% by weight of the detergent composition, of a solution containing 20–60% (preferably 36–45%) of silicate solids (total of $SiO_2$ and $Na_2O$) gives satisfactory results. The solution to be sprayed on the dry mixture is usually at ambient temperature; i.e., between 50° and 100° F. If desired it may be warmed to as high as 160° F for better atomization.

The process of the invention thus provides agglomerated granules suitable for use as automatic dishwashing machine detergent compositions. Normally, a surfactant, especially a nonionic surfactant, is included in the composition. Nonionic surfactants which meet the above criteria and which are advantageously employed in the composition of this invention include, but are not limited to, the following polyoxyalkylene nonionic detergents: $C_8$-$C_{22}$ normal fatty alcohol-ethylene oxide condensates, i.e., condensation products of one mole of a fatty alcohol containing from 8 to 22 carbon atoms with from 3 to b 20 moles of ethylene oxide, polyoxypropylenepolyoxyethylene condensates having the formula $HO(C_2H_4O)_x(C_3H_6O)_y(C_2H_4O)_xH$ where $y$ equals at least 15 and $(C_2H_4O)_{x+x}$, equals 20–90% of the total weight of the compound; alkyl polyoxypropylenepolyoxyethylene condensates having the formula $RO\text{-}(C_3H_6O)_x\ (C_2H_4O)_YH$ where R is a $C_1$-$C_{15}$ alkyl group and $x$ and $y$ each represent an integer from 2 to 98; polyoxyalkylene glycols having a plurality of alternating hydrophobic and hydrophilic polyoxyalkylene chains, the hydrophilic chains consisting of linked oxyethylene radicals and the hydrophobic chains consisting of linked oxypropylene radicals, said product having three hydrophobic chains, linked by two hydrophilic chains the central hydrophobic chain constituting 30% to 34% by weight of the product, the terminal hydrophobic chains together constituting 31% to 39% by weight of the product, the linking hydrophilic chains together constituting 31% to 35% by weight of the product, the intrinsic viscosity of the product being from 0.06 to 0.09 and the molecular weight being from about 3,000 to 5,000 (all as described in U.S. Pat. No. 3,048,548); butylene oxide capped alcohol ethoxylates having the formula $R(OC_2H_4)_y(OC_4H_9)_xOH$ where R is a $C_8$-$C_{18}$ alkyl group and $y$ is an integer from about 3.5 to 10 and $x$ is an integer from about 0.5 to 1.5; benzyl ethers of polyoxyethylene condensates of alkyl phenols having the formula

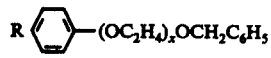

where R is a $C_6$-$C_{20}$ alkyl group and $x$ is an integer from 5 to 40; and alkyl phenoxy polyoxyethylene ethanols having the formula

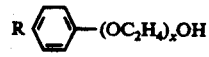

where R is a $C_8$-$C_{20}$ alkyl group and $x$ is an integer from 3 to 20. Other nonionic detergents are suitable for use in the herein-disclosed dishwashing compositions and it is not intended to exclude any detergent possessing the desired attributes.

The nonionic surfactant preferably comprises from about 0.5% to about 35% of the composition and is preferably sprayed onto the agglomerated product prepared by the above-described process. A more preferred range of surfactant level is from 2% to about 15%.

The bleach component previously mentioned that may be part of the particulate matter is a chlorine-yielding bleach. Such bleach is included in the composition at a level sufficient to give the detergent composition an available chlorine content of from 0.5% to 10%, preferably 1% to 5%. As used herein, the term "available chlorine" indicates the amount of chlorine in the composition which is equivalent to elemental chlorine in terms of oxidizing power. "Active chlorine" is oftentimes used instead of "available chlorine". The same type of chlorine is designated by the two terms, but when expressed quantitatively "active chlorine" indicates the chlorine actually present. The numerical value for available chlorine content is twice that for active chlorine. Available chlorine contents below 0.5% fail to give proper cleaning performance, while amounts in excess of 10% do not result in any added cleaning ability. Any of many known chlorine bleaches can be used in the present detergent composition. Examples of such bleach compounds are: chlorinated trisodium phosphate; dichlorocyanuric acid; salts of chlorine substituted cyanuric acid; 1,3-dichloro-5,5-dimethylhydantoin; N,N'-dichlorobenzoylene urea; paratoluene sulfodichloroamide; trichloromelamine; N-chloroammeline; N-chlorosuccinimide; N,N'-dichloroazodicarbonamide; N-chloroacetyl urea; N,N'-dichlorobiurea; chlorinated dicyandiamide; sodium hypochlorite; calcium hypochlorite; and lithium hypochlorite. Depending on the particular bleach utilized, the bleach may be included with the particulate mixture prior to the liquid mixture spray-on or may be admixed with the agglomerated granules of alkaline phosphate, nonionic detergent, and silicate. That is, a bleach that is susceptible to high levels of water and/or heat must be admixed with the agglomerated granules. Similarly a bleach that is not susceptible to water or heat degradation but is of a particle size smaller than desired in the final product must be included with the particulate alkaline builder salt.

The compositions of this invention frequently comprise a suds suppressing agent for the purpose of inhibiting the formation of excessive amounts of foam which can impair the mechanical operation of the dishwashing machine due to a lowering of the pressure at which the washing liquor is impelled against the hard surfaces. Of course, the final selection of the suds suppressing agent depends upon and can be required, in part, because of the qualitative and quantitative characteristics of the particular nonionic surface-active agent which is utilized in the automatic dishwashing compositions herein. In addition, food residues, especially proteinaceous food residues, exhibit suds boosting properties and therefore preferably command the presence of an effective suds regulating agent.

Suds regulating components are normally used in an amount from about 0.001% to about 5%, preferably from about 0.05% to about 3% and especially from about 0.10% to about 1%. The suds suppressing (regulating) agents known to be suitable as suds suppressing agents in detergent context can be used in the compositions herein.

Preferred suds supressing additives are the silicone materials disclosed in U.S. Patent Application Ser. No. 381,659 filed July 23, 1973, inventors Bartolotta et al., incorporated herein by reference. The silicone material can be represented by alkylated polysiloxane materials such as silica aerogels and xerogels and hydrophobic silicas of various types. The silicone material can be described as siloxane having the formula:

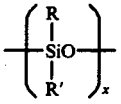

wherein $x$ is from about 20 to about 2,000, and R and R′ are each alkyl or aryl groups, especially methyl, ethyl, propyl, butyl and phenyl. The polydimethylsiloxanes (R and R′ are methyl) having a molecular weight within the range of from about 200 to about 200,000, and higher, are all useful as suds controlling agents. Additional suitable silicone materials wherein the side chain groups R and R′ are alkyl, aryl, or mixed alkyl and aryl hydrocarbyl groups exhibit useful suds controlling properties. Examples of the like ingredients include diethyl-, dipropyl-, dibutyl-, methylethyl-, phenylmethyl-polysiloxanes and the like. Additional useful silicone suds controlling agents can be represented by a mixture of an alkylated siloxane, as referred to hereinbefore, and solid silica. Such mixtures are prepared by affixing the silicone to the surface of the solid silica. A preferred silicone suds controlling agent is represented by a hydrophobic silanated (most preferably trimethylsilanated) silica having a particle size in the range from about 10 millimicrons to 20 millimicrons and a specific surface area above about 50 $m^2$/gm. intimately admixed with dimethyl silicone fluid having a molecular weight in the range from about 500 to about 200,000 at a weight ratio of silicone to silanated silica of from about 19:1 to about 1:2. The silicone suds suppressing agent is advantageously releasably incorporated in a water-soluble or water-dispersible, substantially non-surface-active detergent-impermeable carrier.

Self-emulsifying silicone suds suppressors such as those described in U.S. Patent Application Ser. No. 622,303, filed Oct. 14, 1975 by Gault and Maguire, the disclosure of which is incorporated herein by reference.

Microcrystalline waxes having a melting point in the range from 35° C–115° C and saponification value of less than 100 represent an additional example of a preferred suds regulating component for use in the subject compositions. The microcrystalline waxes are substantially water-insoluble, but are water-dispersible in the presence of organic surfactants. Preferred microcrystalline waxes have a melting point from about 65° C to 100° C, a molecular weight in the range from 400–1,000; and a penetration value of at least 6, measured at 77° F by ASTM-D1321. Suitable examples of the above waxes include: microcrystalline and oxidized microcrystalline petrolatum waxes; Fischer-Tropsch and oxidized Fischer-Tropsch waxes; ozokerite; ceresin; montan wax; beeswax; candelilla; and carnauba wax.

Alkyl phosphate esters represent an additional preferred suds suppressant for use herein. These preferred phosphate esters are predominantly monostearyl phosphate which, in addition thereto, can contain di- and tristearyl phosphates and monooleyl phosphates, which can contain di- and trioleyl phosphates.

The alkyl phosphate esters frequently contain some trialkyl phosphate. Accordingly, a preferred phosphate ester can contain, in addition to the monoalkyl ester, e.g. monostearyl phosphate, up to about 50 mole precent of dialkyl phosphate and up to about 5 mole percent of trialkyl phosphate.

In addition to the components described hereinbefore, the compositions according to this invention can contain additional detergent composition ingredients which are known to be suitable for use in automatic dishwashing compositions in the art-established levels for their known functions. Organic and inorganic detergent builder ingredients, alkali materials, sequestering agents, china protecting agents, corrosion inhibitors, soil suspending ingredients, drainage promoting ingredients, dyes, perfumes, fillers, crystal modifiers and the like ingredients represent examples of functional classes of additional automatic dishwashing composition additives. Suitable inorganic builders include polyphosphates, for example tripolyphosphate, pyrophosphate or metaphosphate, carbonates, bicarbonates and alkali silicates. Examples of water-soluble organic builder components include the alkali metal salts of polyacetates, carboxylates, polycarboxylates and polyhydroxy sulfonates. Additional examples include sodium citrate, sodium oxydisuccinate and sodium mellitate. Normally in granular compositions these builder ingredients can be used in an amount up to 60%, preferably in the range from 10% to 50% by weight.

Suitable examples of sequestering agents include alkali metal salts of ethylenediaminetetraacetic acid and nitrilotriacetic acid.

Examples of china protecting agents include silicates, water-soluble aluminosilicates and aluminates. Carboxymethylcellulose is a well-known soil suspending agent for use in dishwashing compositions whereas fillers for granular compositions are represented by sodium sulfate, sucrose and sucrose esters.

The following examples are illustrative of the present invention.

EXAMPLE I

A dishwashing detergent composition was prepared according to the following procedure. All parts are given by weight.

Anhydrous sodium tripolyphosphate (26.50 parts), sodium sulphate (21.59 parts) and anhydrous sodium silicate (4.60 parts; $SiO_2/Na_2O$ ratio of 2.0; particle size about 200 mesh) were mixed together as a dry mix in a pan granulator. During continued agitation of the dry mix, a sodium silicate solution (23.40 parts containing 9.60 parts of silicate solids, average ratios of $SiO_2/Na_2O$ of 2.86) was sprayed on to the dry mix. The sodium silicate solution also contained prefume (0.10 parts) and dye solution (0.084 parts).

After approximately half of the silicate solution has been sprayed on, a nonionic surfactant (Pluradot HA 433*; 5.50 parts) was also sprayed on to the dry mix. Concurrently with the spray on of nonionic surfactant, there was added chlorinated trisodium phosphate (22.08 parts containing 10.54 parts of water of crystallization).

* PLuradot HA 433 is a polyethylene oxide-polypropylene oxide copolymer marketed by B.A.S.F. Wyandotte and containing monostearyl acid phosphate suds suppressor.

Mixing of the composition was continued for 10 minutes to form 100 parts of the detergent composition.

EXAMPLE II

The procedure of Example I was repeated but using 3.73 parts of the anhydrous sodium silicate and 21.1 parts of sodium sulphate in the dry mix, and spraying on 25.74 parts of the silicate solution. Again, 100 parts of a detergent composition was produced.

EXAMPLE III

The procedure of Example II was repeated but using 5.50 parts of the anhydrous sodium silicate and 24.8 parts of sodium sulphate in the dry mix, and spraying on 21.00 parts of the silicate solution. Again, 100 parts of a detergent composition was produced.

The detergent compositions of the above three examples were all effective dishwashing detergent compositions having little tendency towards carton caking and having good solubility in usage.

What is claimed is:

1. A process for preparing a granular detergent composition comprising the steps of:
   (a) forming a particulate mixture comprising from about 5% to about 35% by weight of the composition of an anhydrous alkaline condensed phosphate and from about 3% to about 10% by weight of the composition of anhydrous alkali metal silicate having a particle size in the range from about 125 to about 300 mesh; and
   (b) with continuous mixing, spraying said particulate mixture with from about 10% to about 35% by weight of the composition of an aqueous solution of an alkali metal silicate having an $SiO_2$/alkali metal oxide ratio in the range from about 1.0 to about 3.6 to form agglomerated granules.

2. A process according to claim 1 wherein from about 4% to about 6% of anhydrous silicate is employed in the dry mix.

3. A process according to claim 1 wherein said anhydrous silicate has a particle size from about 190 to about 250 mesh.

4. A process according to claim 1 wherein said aqueous solution of silicate contains from about 36% to about 45% of silicate solids.

5. A process according to claim 1 wherein from about 0.5% to about 35% of a nonionic surfactant is sprayed on to the dry mix during the agglomeration step.

6. A process according to claim 5 wherein a chlorine-yielding bleaching agent is added during the agglomeration step to give an available chlorine content of from 0.5% to about 10% by weight of the composition.

7. A detergent composition when prepared according to the process of claim 1.

8. A process for preparing a granular detergent composition comprising the steps of:
   (a) forming a particulate mixture comprising from about 15% to about 30% by weight of the composition of anhydrous sodium tripolyphosphate and from about 3% to about 10% by weight of the composition of anhydrous sodium silicate having a particle size in the range from about 125 to about 300 mesh;
   (b) with continuous mixing, spraying said particulate mixture with from about 10% to about 35% by weight of the composition of a 36% to 45% aqueous solution of sodium silicate having an $SiO_2/Na_2O$ ratio of from about 1.0 to about 3.6; and
   (c) during said continuous mixing, spraying on from about 2% to about 15% by weight of the composition of a nonionic surfactant.

9. A process according to claim 8 wherein from about 4% to about 6% of anhydrous silicate is employed in the dry mix.

10. a process according to claim 8 wherein said anhydrous silicate has a particle size from about 190 to about 250 mesh.

11. A process according to claim 8 wherein from about 5% to about 35% by weight of the composition of chlorinated trisodium phosphate is included during step (c).

12. A process according to claim 8 wherein said anhydrous silicate has an $SiO_2/Na_2O$ ratio of about 2.0.

13. A detergent composition when prepared according to the process of claim 8.

* * * * *